US011059708B2

(12) United States Patent
Colbran et al.

(10) Patent No.: US 11,059,708 B2
(45) Date of Patent: Jul. 13, 2021

(54) GRAPPLE

(71) Applicant: S E C Engineering and Design Limited, Hamilton (NZ)

(72) Inventors: Grant Dyson Colbran, Hamilton (NZ); Murray Graeme Wright, Hamilton (NZ); Huu Nam Le, Hamilton (NZ)

(73) Assignee: S E C Engineering and Design Limited, Hamilton (NZ)

( * ) Notice: Subject to any disclaimer, the term of this patent is extended or adjusted under 35 U.S.C. 154(b) by 0 days.

(21) Appl. No.: 16/754,103

(22) PCT Filed: Oct. 8, 2018

(86) PCT No.: PCT/NZ2018/050138
§ 371 (c)(1),
(2) Date: Apr. 6, 2020

(87) PCT Pub. No.: WO2019/074379
PCT Pub. Date: Apr. 18, 2019

(65) Prior Publication Data

US 2020/0331736 A1 Oct. 22, 2020

(30) Foreign Application Priority Data

Oct. 13, 2017 (NZ) ..... 736408

(51) Int. Cl.
*B66F 9/18* (2006.01)
*B66F 9/22* (2006.01)
(Continued)

(52) U.S. Cl.
CPC ..... *B66F 9/18* (2013.01); *B66C 3/16* (2013.01); *B66F 9/22* (2013.01); *B66C 1/585* (2013.01); *B66F 9/065* (2013.01)

(58) Field of Classification Search
CPC .. B66C 1/44; B66C 1/585; B66C 3/14; B66C 3/16; B66C 3/20; B66F 9/18; B66F 9/22; B66F 9/065; E04H 12/347
(Continued)

(56) References Cited

U.S. PATENT DOCUMENTS 2,949,201 A 8/1960 MacAlpine et al.
3,187,916 A 6/1965 O'Leary
(Continued)

FOREIGN PATENT DOCUMENTS

CN 201236107 Y 5/2009
CN 104444795 A 3/2015
(Continued)

OTHER PUBLICATIONS

Australian Patent Office, Written Opinion for Application No. PCT/NZ2018/050138, dated Jan. 24, 2019, pp. 1-7.
(Continued)

*Primary Examiner* — Dean J Kramer
(74) *Attorney, Agent, or Firm* — Cahn & Samuels, LLP

(57) ABSTRACT

A grapple for mounting to a boom of a boom crane includes a body member for mounting to the end of a boom of a boom crane including a first wing member and a second wing member and opposing first and second jaw members. Each jaw is hingably coupled to the body member, and hinges with respect to the body member by the action of a hydraulic cylinder. A first end of the hydraulic cylinder is coupled to the jaw member and a second end of the hydraulic cylinder is coupled to a portion of one of the wing members. The first and second wing members extend to position the second end of each hydraulic cylinder rearward of an end of the boom of the boom crane or a coupling between the body member and the boom of the boom crane.

18 Claims, 13 Drawing Sheets

(51) Int. Cl.
*B66C 3/16* (2006.01)
*B66F 9/065* (2006.01)
*B66C 1/58* (2006.01)

(58) Field of Classification Search
USPC ..... 414/23, 739, 745.2
See application file for complete search history.

(56) References Cited

U.S. PATENT DOCUMENTS 4,108,224 A * 8/1978 Wirt ..... A01G 23/089 144/34.5
4,669,940 A * 6/1987 Englehardt ..... B65F 3/08 294/106
4,718,816 A * 1/1988 King ..... B66C 1/447 414/23
5,083,895 A * 1/1992 McBirnie ..... B66C 1/447 414/728
5,702,139 A * 12/1997 Buck ..... B25B 5/147 294/106
5,769,592 A * 6/1998 Christenson ..... B65F 3/046 414/408
6,244,643 B1 6/2001 Tillaart
6,457,761 B1 10/2002 Benoit

FOREIGN PATENT DOCUMENTS

DE 24 21 624 A1 11/1975
JP S51 151366 U 12/1976
WO 2014051438 A1 4/2014

OTHER PUBLICATIONS

Australian Patent Office, International Search Report for Application No. PCT/NZ2018/050138, dated Jan. 24, 2019, pp. 1-6.
Australian Patent Office, International Preliminary Report on Palatability for Application No. PCT/NZ2018/050138, dated May 21, 2019, pp. 1-15.
European Patent Office, Supplementary European Search Report in EP App. No. 18 86 6609, dated Oct. 30, 2020, pp. 1-8.

* cited by examiner

GRAPPLE

STATEMENT OF CORRESPONDING APPLICATIONS

This application is based on the provisional specification filed in relation to New Zealand Patent Application Number 736408, the entire contents of which are incorporated herein by reference.

TECHNICAL FIELD

The invention relates to a grapple for use with boom cranes. In particular, the invention provides a grapple that is suited for use with a knuckle boom crane to allow grappling of poles, posts, logs and the like.

BACKGROUND

There are a large variety of cranes available for shifting loads. A common example of such a crane is the boom crane, which can be mobile or fixed. A specific example of a mobile boom crane is a knuckle boom crane otherwise known as a knuckle crane, loader crane, articulating crane, or picker crane.

The knuckle boom crane may be thought of having two booms—a main boom and an outer boom and it is the articulation (knuckle) between them which provides the ability to bend back like a knuckle on a finger. This degree of articulation provides the crane with a significant degree of operating range and allows the crane to be folded compactly in contrast to other boom crane designs. The outer boom may be substantially unitary in construction, or may be formed from a plurality of boom members—typically telescoping boom members (which may be referred to as boom extensions). The telescoping boom members may be telescopically extended or retracted by the action of hydraulic cylinders, rope, chain, cable, etc. The most outward of the telescoping boom members may be referred to as the terminal boom member and typically will include a boom eye for mounting chain/strop to so as to attach a load.

The compact design and range of the knuckle boom crane makes them ideally suited for use in mobile situations such as on the back of a truck. Knuckle boom cranes are also able to be made out of relatively lightweight materials. Indeed, they are ideally as light as possible without sacrificing strength, otherwise the load on the carrier (eg truck) will exceed its design rendering the knuckle boom crane useless for all but the lightest of loads.

Various attachments can be attached to boom cranes (particularly knuckle boom cranes) to adapt them to various purposes. The attachments are typically attached to the outer boom, and where present the terminal boom member. Examples of such attachments include buckets, pallet forks, brick/block grabs, scrap metal grapples, and pole/log grapples. The versatility of the available attachments and the manoeuvrability of the knuckle boom crane itself has led to the widespread use of this operating system.

These types of cranes have been particularly utilized in the transport, construction, forestry, mining, marine, and petroleum industries.

At present, however, operators looking to manoeuvre poles/posts/logs have limited options, particularly when the size of the knuckle boom crane is reduced. In particular, the pole/post/log grapples currently available suffer from the following disadvantages:

- they are heavy and therefore compromise the lifting capacity of the crane which has a maximum lifting weight limit which has to account for the weight of the boom and attachment;
- they typically hang limply from the end of the outer boom and therefore limit the ability of the operator to safely manipulate the pole/log into a vertical orientation;
- they typically damage the poles/posts/logs (especially concrete poles) because of the nature of the grapple jaws; and
- they cannot be left on the end of the boom while the standard crane hook is being used since they interfere with the access to the standard crane hook and/or interfere with the range of the boom as they protrude from the boom.

Owing to many of the problems discussed above, many operators choose to simply use strops/chains to hang the pole/log off the boom crane to reduce downtime in changing boom attachments and also to maximise lifting capacity by using a lightweight attachment.

The use of strops/chains to hoist a pole/post/log has numerous disadvantages however, including:

- endangering the operator as the load typically can swing around particularly in heavy wind;
- the strop/chain has a load limit intrinsic to the material that the strop/chain is made out of;
- the strop/chain must be manually secured to each pole/post/log and then manually unsecured once in position which can be awkward and time/labour intensive.

Also, when lines men are required to work on line-poles or lines supported by a line-pole, typically access to the lines or top of the pole is via a ladder placed against the line-pole. This puts the lines-man at risk of a dangerous fall should the line-pole fail while the lines-man is up the ladder. Therefore, it would be of benefit if some form of pole support could be provided, to hold and/or support a line-pole when a lines-man has a ladder propped against the line-pole.

An object of the invention is to provide an attachment for a boom crane, particularly a knuckle boom crane, which in use overcomes the above disadvantages and/or is easily installed and/or saves time and/or reduces costs, and/or improves safety for lines-men working on line-poles or lines carried by line-poles.

It is an object of the present invention to address one or more of the foregoing problems or at least to provide the public with a useful choice.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the invention will become apparent from the following description which is given by way of example only.

SUMMARY OF THE INVENTION

In one aspect the invention provides a grapple for mounting to the boom of a boom crane, the grapple including:

i) a body member for mounting to the end of the boom of a boom crane, the body member including a first wing member and a second wing member; and ii) opposing first and second jaw members, wherein:

a) the first jaw member is hingably coupled to the body member and the first jaw member hinges with respect to the body member by the action of a first hydraulic cylinder having a first end and a second end, wherein the first end of the first hydraulic cylinder is coupled to the first jaw member and the second end of the first hydraulic cylinder is coupled to a portion of the first wing member distal to the hingable couple between the body member and the first jaw member; and b) the second jaw member is hingably coupled to the body member and the second jaw member hinges with respect to the secondary wing member by the action of a second hydraulic cylinder having a first end and a second end, wherein the first end of the second hydraulic cylinder is coupled to the second jaw member and the second end of the first hydraulic cylinder is coupled to a portion of the second wing member distal to the hingable couple between the body member and the second jaw member; and wherein the first and second wing members extend to position the second end of each of the first and second cylinders rearward of an end of the boom of the boom crane or a coupling between the body member and the boom of the boom crane.

Advantageously, the grapple of the present invention can provide a lightweight construction design, and the ability to retract the opposing jaw members so that the grapple does not protrude excessively from the end of the boom. Without wishing to be bound by theory, it is believed that the first and second wing members provide optimal clearance and leverage to enable the opposing jaws to retract to the significant degree that they can do. It is also believed that the wings achieve an improved range of motion, from a tightly closed position to a fully open position with the jaws retracted to the significant degree that they do.

In a preferred embodiment, the first and second wing members extend laterally outwards from the boom to position the second end of each of the first and second hydraulic cylinders laterally outside of the first end of each of the first and second hydraulic cylinders, so that the first and second hydraulic cylinders diverge from the first end of the first and second hydraulic cylinders to the second end of the first and second hydraulic cylinders.

Preferably, the second end of each of the first and second hydraulic cylinders is positioned laterally outside of the first end of each of the first and second hydraulic cylinders for a full range of motion of the first and second jaws between a fully closed position and a fully open position.

Preferably the range of movement and/or manoeuvrability of the grapple may be enhanced by articulating the body member—so that the body member includes a primary body member fixed to the boom and a secondary body member articulated to the primary body member by a coupling, with the first and second jaw members hingably coupled to the second body member, and the secondary body member including the first and second wing members.

Preferably, the secondary body member is hingably coupled to the primary body member by the coupling.

Preferably, the first and second jaw members are each hingably to the body member about a pivot axis that is orthogonal to a pivot axis of the hingable coupling between the primary body member and the secondary body member.

Preferably, the grapple comprises a third hydraulic cylinder having a first end and a second end, wherein the first end of the third hydraulic cylinder is coupled to the secondary body member and the second end of the third hydraulic cylinder is configured to couple to the primary body member or the boom of the boom crane distal to the secondary body member, so that the secondary body member hinges with respect to the primary body member by the action of the third hydraulic cylinder.

Preferably, the first and second wing members extend from the secondary body member to position the second end of each of the first and second hydraulic cylinders rearward of the coupling between the primary body member and the second body member.

Preferably, the first and second wing members extend from the secondary body member to position the second end of each of the first and second hydraulic cylinders rearward of the primary body member.

Preferably, the primary body member comprises a first bearing member and a second bearing member, and wherein the first wing member slides over the first bearing member and the second wing member slides over the second bearing member as the secondary body member hinges relative to the primary body member.

Preferably, the secondary member comprises a U-shaped base, each of the first and second wing members extending from an outer side of the U-shaped base, and wherein inner sides of the U-shaped base slide over the first and second bearing members of the primary body member.

Preferably, in a full open position the first end of each of the first and second hydraulic cylinders is rearward of the hingable coupling between each of the first and second jaws and the body member.

Preferably, the boom comprises a boom-eye for attaching a lifting element, and the first and second wings position the second end of each of the first and second hydraulic cylinders rearward of the boom eye.

In a second aspect the invention provides a grapple for mounting to the boom of a boom crane, the grapple including:

i) a body member for mounting to the end of a boom of a boom crane, the body member including a first wing member and a second wing member; and ii) opposing first and second jaw members, wherein:

a) the first jaw member is hingably coupled to the body member and the first jaw member hinges with respect to the body member by the action of a first hydraulic cylinder having a first end and a second end, wherein the first end of the first hydraulic cylinder is coupled to the first jaw member and the second end of the first hydraulic cylinder is coupled to a portion of the first wing member distal to the hingable couple between the body member and the first jaw member; and b) the second jaw member is hingably coupled to the body member and the second jaw member hinges with respect to the secondary wing member by the action of a second hydraulic cylinder having a first end and a second end, wherein the first end of the second hydraulic cylinder is coupled to the second jaw member and the second end of the first hydraulic cylinder is coupled to a portion of the second wing member distal to the hingable couple between the body member and the second jaw member; and wherein the first and second wing members extend laterally outwards from the boom to position the second end of each of the first and second hydraulic cylinders laterally outside of the first end of each of the first and second hydraulic cylinders, so that the first and second hydraulic cylinders diverge from the first end of the first and second hydraulic cylinders to the second end of the first and second hydraulic cylinders.

Preferably the second end of each of the first and second hydraulic cylinders is positioned laterally outside of the first end of each of the first and second hydraulic cylinders for a full range of motion of the first and second jaws between a fully closed position and a fully open position.

In a third aspect the invention provides a grapple for mounting to the outer boom of a boom crane, the grapple including:

i) a primary body member for mounting fixedly to the end of the boom of a boom crane;

ii) a secondary body member articulated to the primary body member, the secondary body member including a first wing member and a second wing member; and iii) opposing first and second jaw members, wherein:

a) the first jaw member is hingably coupled to the secondary body member and the first jaw member hinges with respect to the secondary body member by the action of a first hydraulic cylinder having a first end and a second end, wherein the first end of the first hydraulic cylinder is coupled to the first jaw member and the second end of the first hydraulic cylinder is coupled to a portion of the first wing member distal to the hingable couple between the secondary body member and the first jaw member; and b) the second jaw member is hingably coupled to the secondary body member and the second jaw member hinges with respect to the secondary wing member by the action of a second hydraulic cylinder having a first end and a second end, wherein the first end of the second hydraulic cylinder is coupled to the second jaw member and the second end of the first hydraulic cylinder is coupled to a portion of the second wing member distal to the hingable couple between the secondary body member and the second jaw member; and wherein the first and second wing members extend to position the second end of each of the first and second cylinders rearward of an end of the boom of the boom crane or the coupling between the primary body member and the secondary body member.

Preferably the secondary body member is hingably coupled to the primary body member by the coupling.

Preferably the secondary body member hinges with respect to the primary body member by the action of a third hydraulic cylinder having a first end and a second end, wherein the first end of the third hydraulic cylinder is coupled to the secondary body member and the second end of the third hydraulic cylinder is configured to couple to a portion of the boom of the boom crane to which it is mounted distal to the secondary body member.

Accordingly, in a fourth aspect the invention provides a grapple for mounting to the outer boom of a boom crane, the grapple including:

i) a primary body member for mounting fixedly to the end of the boom of a boom crane;

ii) a secondary body member hingably coupled to the primary body member, the secondary body member including a first wing member and a second wing member;

iii) opposing first and second jaw members, wherein:

a) the first jaw member is hingably coupled to the secondary body member and the first jaw member hinges with respect to the secondary body member by the action of a first hydraulic cylinder having a first end and a second end, wherein the first end of the first hydraulic cylinder is coupled to the first jaw member and the second end of the first hydraulic cylinder is coupled to a portion of the first wing member distal to the hingable couple between the secondary body member and the first jaw member; and b) the second jaw member is hingably coupled to the secondary body member and the second jaw member hinges with respect to the secondary wing member by the action of a second hydraulic cylinder having a first end and a second end, wherein the first end of the second hydraulic cylinder is coupled to the second jaw member and the second end of the first hydraulic cylinder is coupled to a portion of the second wing member distal to the hingable couple between the secondary body member and the second jaw member;

iv) a third hydraulic cylinder having a first end and a second end, wherein the first end of the third hydraulic cylinder is coupled to the secondary body member and the second end of the third hydraulic cylinder is configured to couple to a portion of the boom of the boom crane distal to the secondary body member, so that the secondary body member hinges with respect to the primary body member by the action of the third hydraulic cylinder; and wherein the first and second wing members extend to position the second end of each of the first and second cylinders rearward of an end of the boom of the boom crane or the coupling between the primary body member and the secondary body member.

The second, third and fourth aspects of the invention may include any one or more of the features described above in relation to the first aspect of the present invention.

In this specification and claims, unless the context suggests otherwise, the term 'hydraulic cylinder' is a well-known term used to refer to a hydraulic actuator comprising a piston rod with piston received in a cylinder.

Further aspects of the invention which should be considered in all its novel aspects will become apparent from the following description which is given by way of example only.

DESCRIPTION OF THE DRAWINGS

Examples of the invention will now be described with reference to the accompanying drawings in which.

DESCRIPTION OF THE EXAMPLES

The invention will now be described with reference to an exemplary grapple wherein the body member includes a primary body member pivotally coupled to a secondary body member. In the exemplary embodiment, the primary body member is hingably coupled to a secondary body member. It is to be appreciated that the grapple can be used in a wide variety of other situations.

Figure 1:
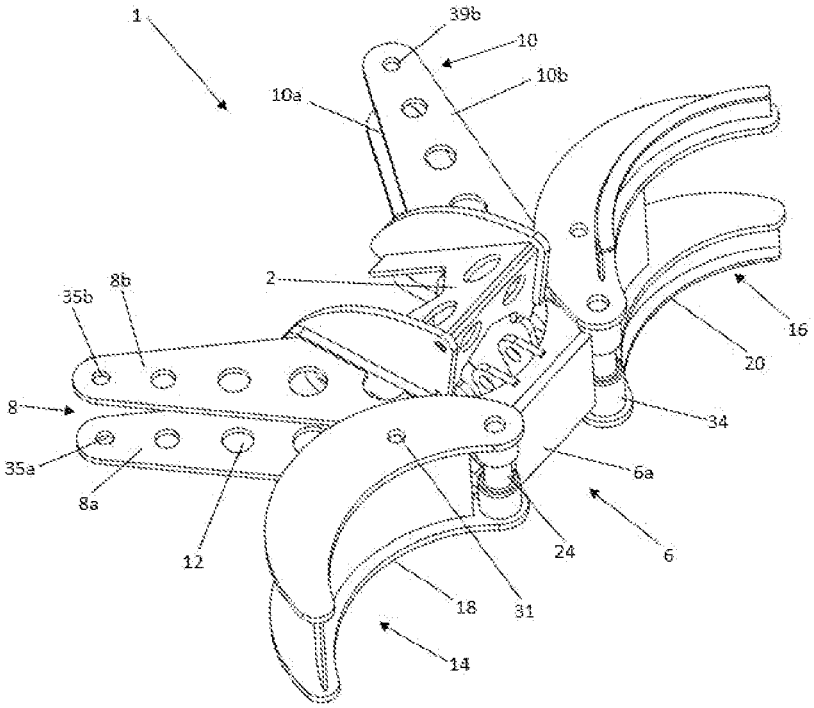
FIG. 1 shows a perspective view of a grapple from an above position wherein the opposing jaws are retracted and each of the hydraulic cylinders are omitted.
Figure 2:
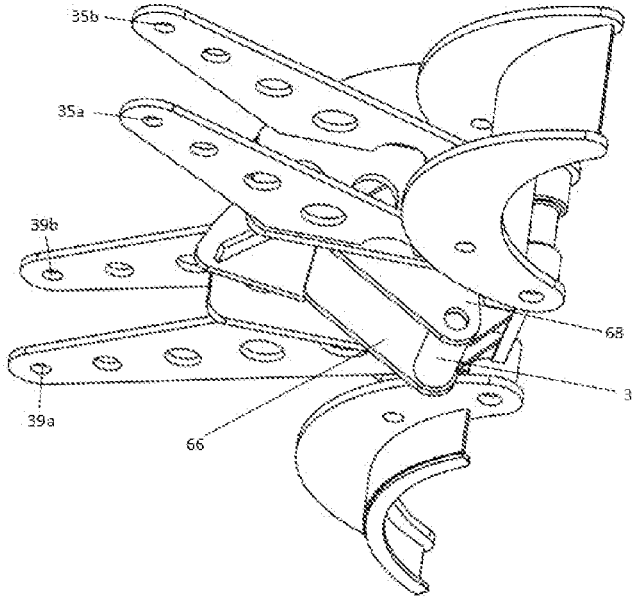
FIG. 2 shows a perspective view of the grapple from a below position wherein the opposing jaws are retracted and each of the hydraulic cylinders are omitted.
Figure 3:
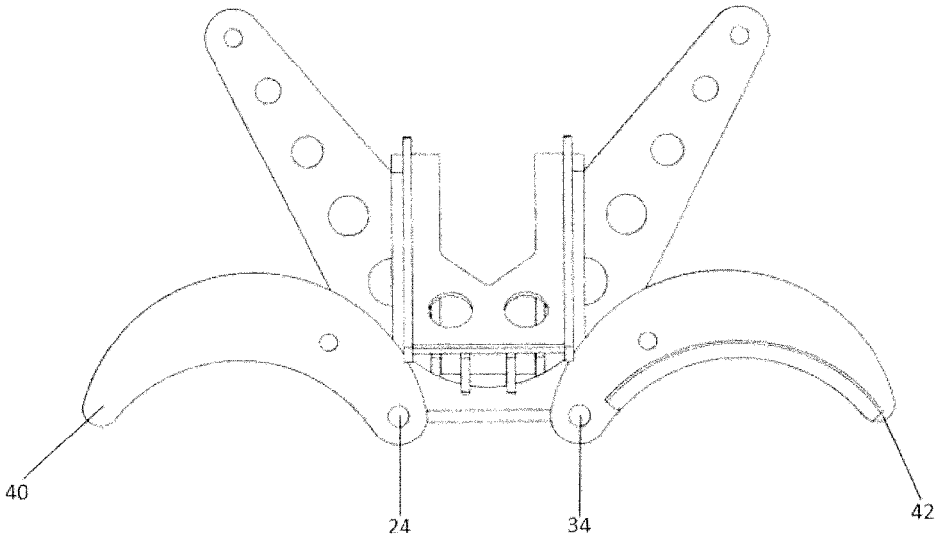
FIG. 3 shows a plan view of the grapple from an above position wherein the opposing jaws are retracted and each of the hydraulic cylinders are omitted.
Figure 4:
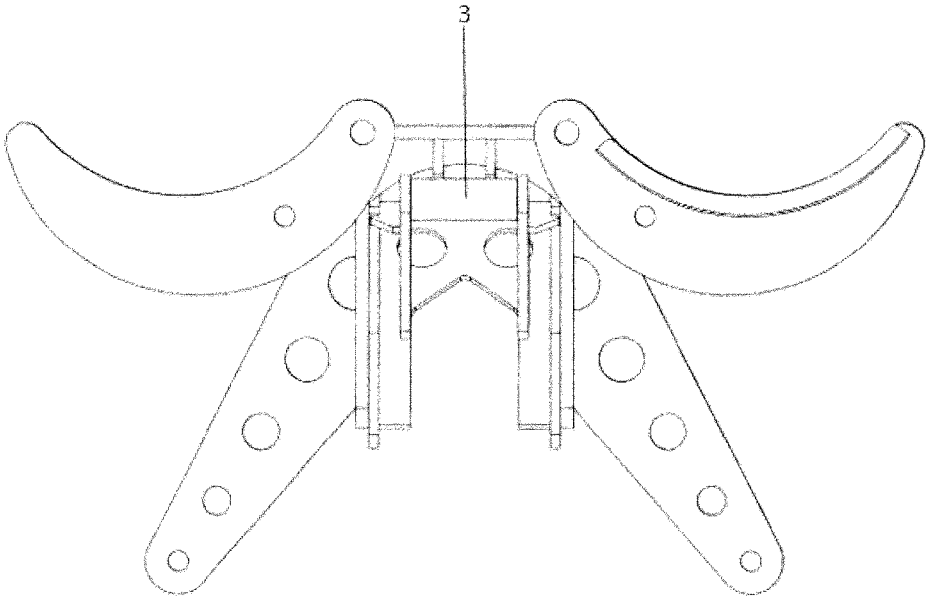
FIG. 4 shows a plan view of the grapple from a below position wherein the opposing jaws are retracted and each of the hydraulic cylinders are omitted.
Figure 5:
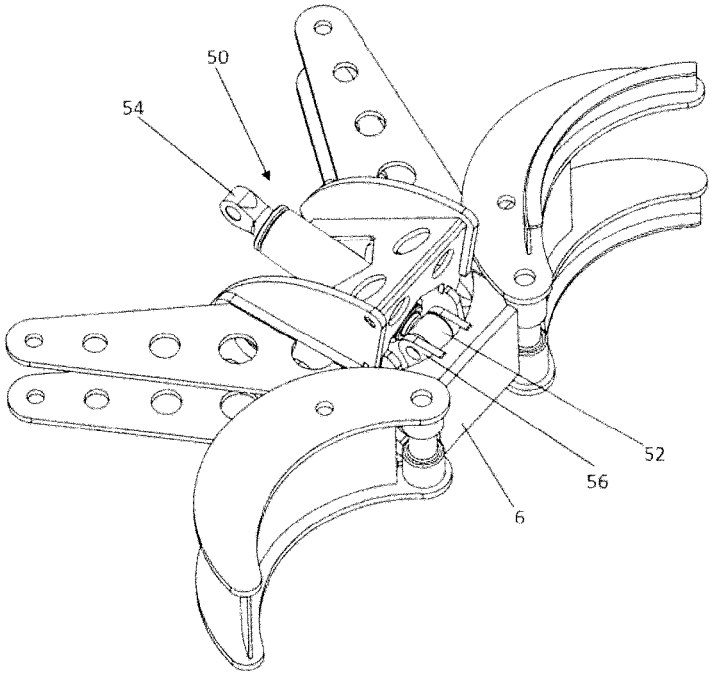
FIG. 5 shows a perspective view of the grapple from an above position wherein the opposing jaws are retracted and the first and second hydraulic cylinders are omitted.
Figure 6:
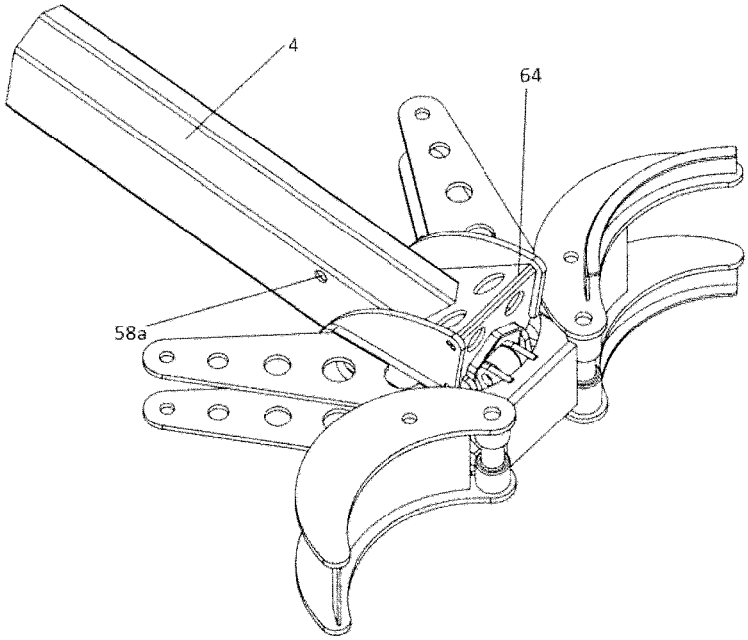
FIG. 6 shows a perspective view of the grapple from an above position mounted to an outer boom wherein the opposing jaws are retracted and the first and second hydraulic cylinders are omitted.

FIG. 1 shows a perspective view of an exemplary grapple (1) of the invention, wherein the first hydraulic cylinder and the second hydraulic cylinder have been omitted for clarity. The grapple includes a primary body member (2) for mounting fixedly to the end of the outer boom of a boom crane (4; FIG. 6). The grapple (1) also includes a secondary body member (6) hingably coupled (3; FIG. 2) to the primary body member (2). It will be understood that such a hingable couple (3) allows movement of the primary body member (2) with respect to the secondary body member in two dimensions about a pivot axis of the hingable couple (3), i.e. the hingable couple (3) providing a single degree of freedom of movement. In other embodiments, the secondary body member is otherwise articulated to the primary body member, for example via a swivel joint, or a ball joint providing three degrees of freedom of movement. With the primary body member fixed to the end of the boom, the coupling 3 is between the boom and the secondary body member to provide articulation between the boom and the secondary body member. As used herein two-dimensional movement or single degree of freedom of movement (i.e. about a pivot pin or axis) is referred to as the "tilt" of the grapple jaw members with respect to the boom.

The secondary body member (6) includes base (6*a*) and a first wing member (8) and a second wing member (10) extending from the base. In this example, each of the first and second wing members include a pair of substantially identical planar members (8*a*, 8*b*, 10*a*, 10*b*), the major planes of which are substantially parallel. Although this design is preferred, it will be understood that the wing members function to provide a point of hydraulic cylinder attachment distal to the base of the secondary body member (outlined below) and as such any design capable of performing that function is within the scope of the present invention. The overall weight of the grapple may be reduced by removing non-critical elements from the grapple, including by forming, stamping, drilling, etc holes (12) in the first and second wing members.

The grapple (1) also includes opposing first (14) and second (16) jaw members. The opposing jaw members provide the function of grappling the pole/post/log/etc and as such any design that performs that function is contemplated. Grapples commonly in use include opposing curved internal surfaces (18 and 20) that form a grasping shape of ever decreasing dimension as the jaws close so as to securely grapple a curved object such as a pole or log. Furthermore, the internal surfaces (18 and 20) of the jaws may be provided with a soft material such as a plastic, such as a rubber (not shown), which is a preferred feature where delicate objects such as concrete poles are to be grappled. For instance a 5-50 mm (such as 10-30 mm, such as 20 mm) rubber lining may be used to line the internal surfaces (18 and 20) of the jaws. Despite curved internal surfaces (18 and 20) being preferred, other shapes may be employed including the use of a straight profile. The internal surfaces (18 and 20) may also be provided with gripping elements on the profile such as serrations where damage to the object being grappled is of lesser concern.

Figure 22:
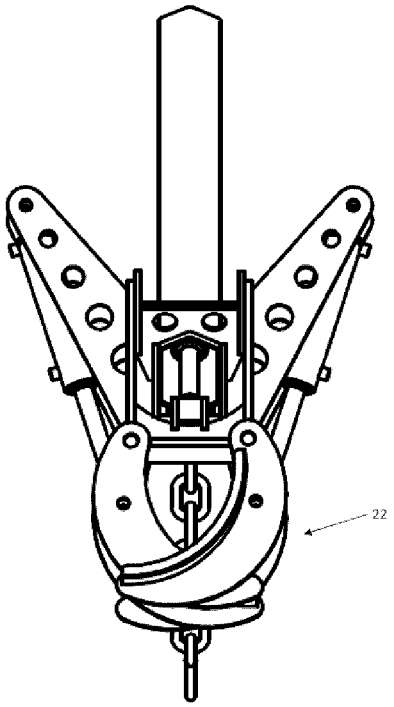
FIG. 22 shows a plan view of the grapple from an above position mounted to an outer boom including a chain and hook mounted to the boom, wherein the opposing jaws are fully closed. The grapple is tilted up by about 10°.

Furthermore, in the exemplary grapple shown, the opposing jaws (14 and 16) are capable of interleaving (22; FIG. 22) which provides the opposing jaws with the ability to securely grapple objects of a broad range of dimensions. The interleaving mechanism may be provided by configuring the second jaw member with a plurality of jaw elements ortines so as to enable the first jaw member to close between those jaw elements or tines. In the grapple shown in FIG. 1 the first jaw member consists of one major jaw tine and the second jaw member consists of two jaw tines, however the invention contemplates any design of a plurality of tines on one or both of the jaw members.

The first jaw member (14) is hingably coupled (24) to the base (6*a*) of the secondary body member (6). It will be understood that such a hingable couple or coupling (24) allows movement of the first jaw member with respect to the secondary body member in two dimensions about a pivot axis, i.e. a single degree of freedom of movement. In the exemplary embodiment, the first jaw member hinges about a pivot axis of the hingable coupling (24) orthogonal to a pivot axis of the hingable couple (3) between the primary body member (2) and the secondary body member (6).

Figure 10:
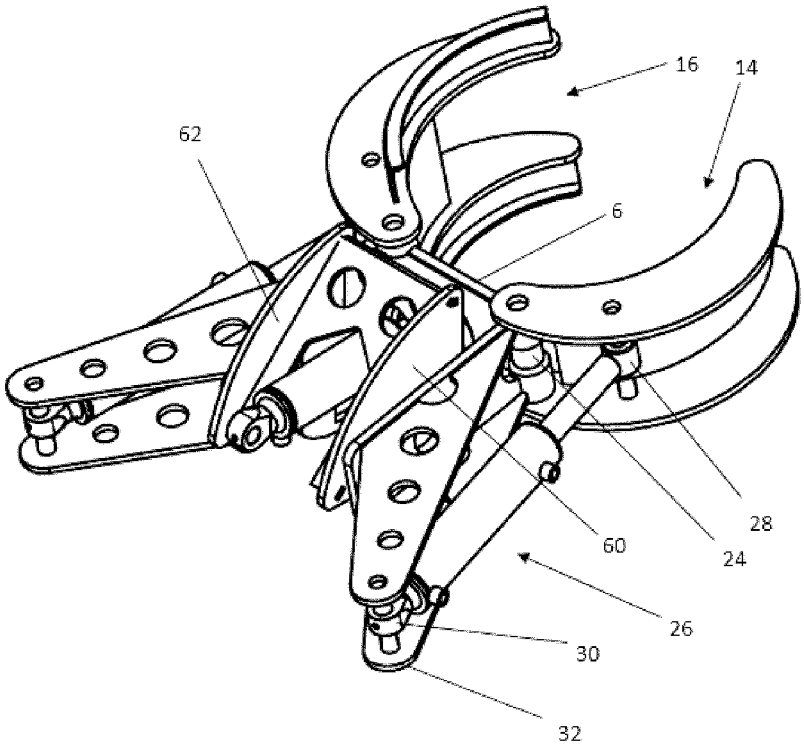
FIG. 10 shows a perspective view of the grapple from an above position wherein the opposing jaws are semi-retracted and the hydraulic cylinders are shown. The grapple is in a neutral tilt position.
Figure 11:
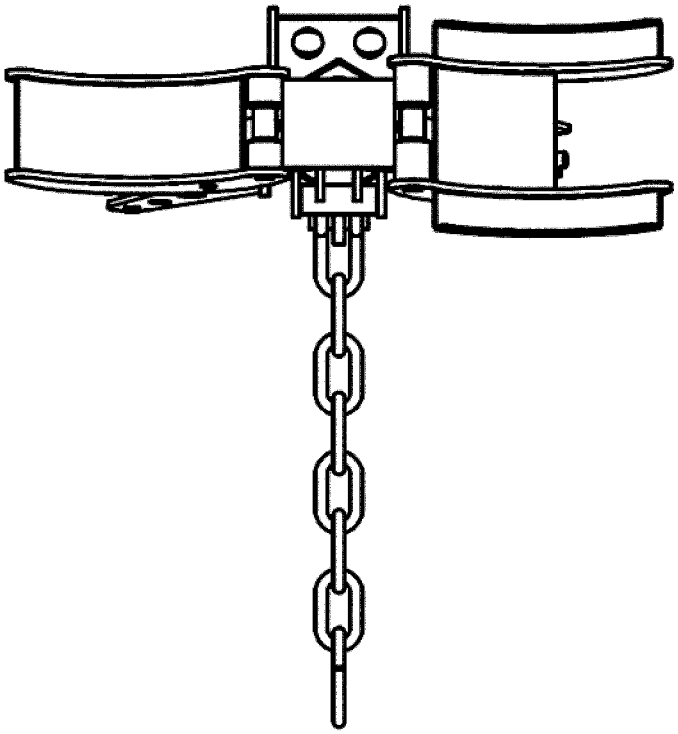
FIG. 11 shows a receiving end view of the grapple mounted to an outer boom including a chain and hook mounted to the boom, wherein the opposing jaws are retracted. The grapple is tilted up by about 10°.
Figure 12:
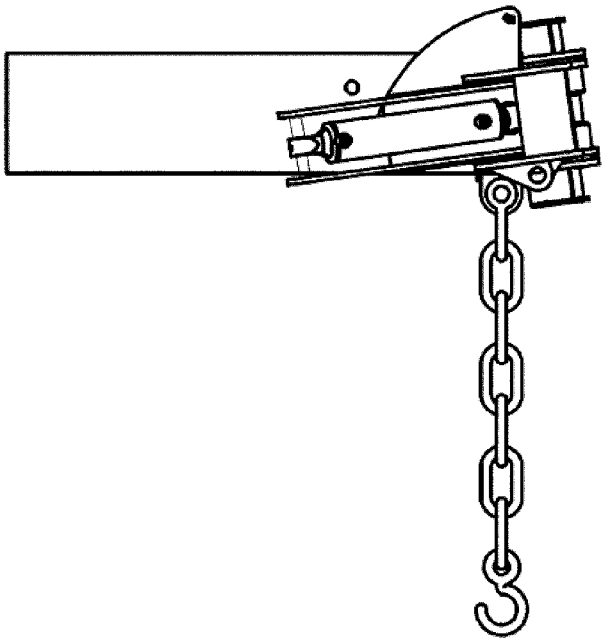
FIG. 12 shows a side view of the grapple mounted to an outer boom including a chain and hook mounted to the boom, wherein the opposing jaws are retracted. The grapple is tilted up by about 10°.

The grapple (1) includes a first hydraulic cylinder (26; FIG. 10) having a first end (28; FIG. 10) and a second end (30; FIG. 10). The first end (28) of the first hydraulic cylinder (26) is coupled to the first jaw member (14), typically through a hingable couple suitably used to mount hydraulic cylinders (bushings, bearings, pins, etc) and may make use of mounting holes (31; FIG. 1) formed in the first jaw member. The second end (30) of the first hydraulic cylinder (26) is coupled (typically through a hingable couple suitably used to mount hydraulic cylinders—bushings, bearings, pins, etc) to a portion (32) of the first wing member distal to the hingable couple (24) between the secondary body member (6) and the first jaw member (14). Mounting holes (35*a* and 35*b*; FIG. 1) may be formed in portion (32). In use, as the first hydraulic cylinder expands the first jaw member is forced away from (32), and hinges about the hingable couple (24) so as to close the first jaw member (14). Conversely, as the first hydraulic cylinder retracts the first jaw member is forced towards (32), and hinges about the hingable couple (24) so as to open the first jaw member (14).

Likewise, the second jaw member (16) is hingably coupled (34) to the base (6*a*) of the secondary body member (6). It will be understood that such a hingable couple (34) allows movement of the first jaw member with respect to the secondary body member in two dimensions about a pivot axis, i.e a single degree of freedom of movement. In the exemplary embodiment, the second jaw member hinges about a pivot axis of the hingable coupling (34) orthogonal to a pivot axis of the hingable couple (3) between the primary body member (2) and the secondary body member (6).

Figure 9:
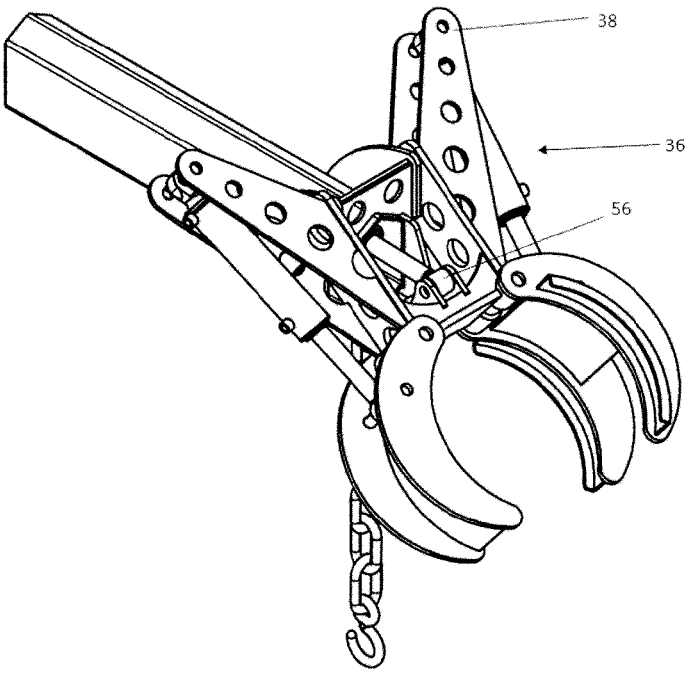
FIG. 9 shows a perspective view of the grapple from an above position mounted to an outer boom wherein the opposing jaws are semi-retracted and the hydraulic cylinders are shown. The grapple is tilted down by about 10°.

The grapple (1) includes a second hydraulic cylinder (36; FIG. 9) having a first end (not shown) and a second end (not shown). The first end (not shown) of the second hydraulic cylinder (36) is coupled to the second jaw member (16), typically through a hingable couple used to mount hydraulic cylinders. The second end (not shown) of the second hydraulic cylinder (36) is coupled (typically through a hingable couple used to mount hydraulic cylinders) to a portion (38; FIG. 9) of the second wing member distal to the hingable couple between the secondary body member (6) and the second jaw member (16). Mounting holes (39*a* and 39*b*; FIG. 2) may be formed in portion (38). In use, as the second hydraulic cylinder expands the second jaw member is forced away from (38), and hinges about the hingable couple (34) so as to close the first jaw member (16). Conversely, as the second hydraulic cylinder retracts the second jaw member is forced towards (38), and hinges about the hingable couple (34) so as to open the first jaw member (16).

It will be understood that the first and the second hydraulic cylinders may be operated independently and may be operated in different directions (i.e. retract or extend), at different rates. However, the first and the second hydraulic cylinders will typically be operated in unison so that the first and second jaw members move in unison—that is they move apart or they move together at the same rate.

Figure 7:
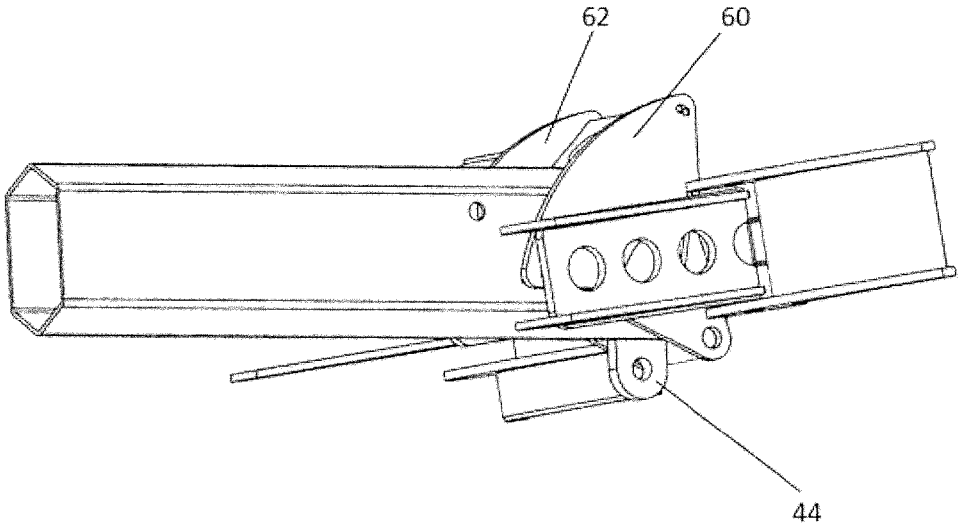
FIG. 7 shows a perspective view of the grapple from a below position mounted to an outer boom wherein the opposing jaws are retracted and the hydraulic cylinders are omitted. The grapple is tilted up by about 10°.
Figure 8:
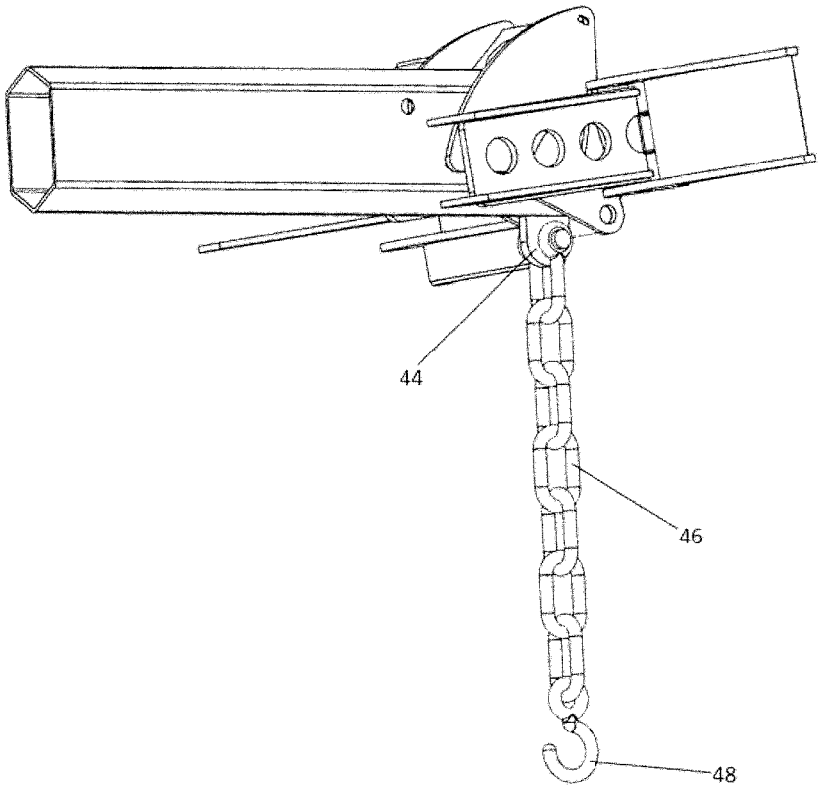
FIG. 8 shows a perspective view of the grapple from a below position mounted to an outer boom including a chain and hook mounted to the boom, wherein the opposing jaws are retracted and the hydraulic cylinders are omitted. The grapple is tilted up by about 10°.
Figure 16:
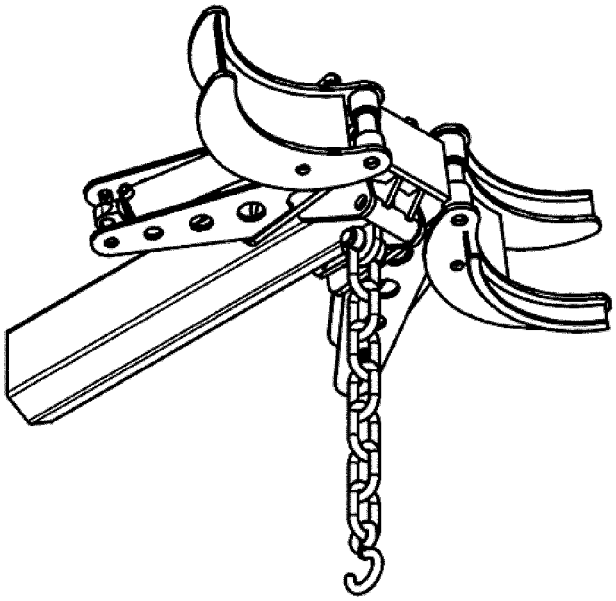
FIG. 16 shows a plan view of the grapple from an above position mounted to an outer boom including a chain and hook mounted to the boom, wherein the opposing jaws are fully retracted. The grapple is tilted up by about 10°.

The wings (8, 10) extend from the base in a rearward or boom-ward direction, i.e. a direction along the boom away from the jaws (14, 16) and hingable couplings (24, 34), so that second end 30 of each hydraulic cylinder is located rearward of the end of the boom or a coupling between the body member and the boom, and/or rearward of the primary body member. Where the boom has a boom eye (44; FIG. 7), the wings may position the second end of each hydraulic cylinder rearward of the boom eye. Advantageously the present invention allows the first and second jaw members to move apart so that the extremities of the first and second jaw members (40 and 42 respectively) may be retracted rearward (boom-ward) of a plane through the hingeable couplings (24) and (34). The present invention allows the first and second jaw members to move apart to a fully open position so that the jaws do not extend substantially beyond the end of the body member(s) 2, 6 attached to the end of the boom. The primary advantage offered by this range of movement is that the grapple at the end of the boom may be manoeuvred close to surrounding objects, so that the boom eye (44; FIG. 7), which is a standard point of attachment to the boom and is typically integral with the outer boom, can continue to be used near to the surrounding objects. One particular use of the boom eye is to mount chain link (46) which terminates at a hook (48) or the like. By being able to retract boom ward of the plane of hingeable couplings (24) and (34) or to a position whereby the jaws do not extend substantially beyond the body member 2, 6, the grapple of the invention projects minimally (FIG. 16) beyond the end of the boom and the boom eye and therefore does not provide any substantial hindrance to the simultaneous/sequential use of the boom eye. In particular, there is typically no need to detach the grapple to use the boom eye as compared with the previous approaches to providing boom cranes with grapple attachments.

As described, the hingable couple (3) between the primary and secondary body members allows movement of the primary body member (2) with respect to the secondary body member (6) in two dimensions. As used herein that two dimensional movement is referred to as the "tilt" of the grapple jaws (14 and 16) with respect to the boom (4).

Typically, the secondary body member (6) hinges with respect to the primary body member (2) by the action of a third hydraulic cylinder (50) having a first end (52) and a second end (54), wherein the first end (52) of the third hydraulic cylinder (50) is coupled (56) to the secondary body member (6) and the second end (54) of the third hydraulic cylinder (50) is coupled (not shown) to a portion of the outer boom (4) of the boom crane to which it is mounted distal to the secondary body member (6). Mounting holes (e.g. 58*a*; FIG. 6) may be formed in the outer boom (4).

As shown in the exemplary embodiment, the wings (8, 10) position the second end of each hydraulic cylinder rearward of the pivot coupling (3) between the primary and secondary body members. Thus, the wings (8, 10) tilt together with the jaws (14, 16) and cylinders (26, 36).

Figure 15:
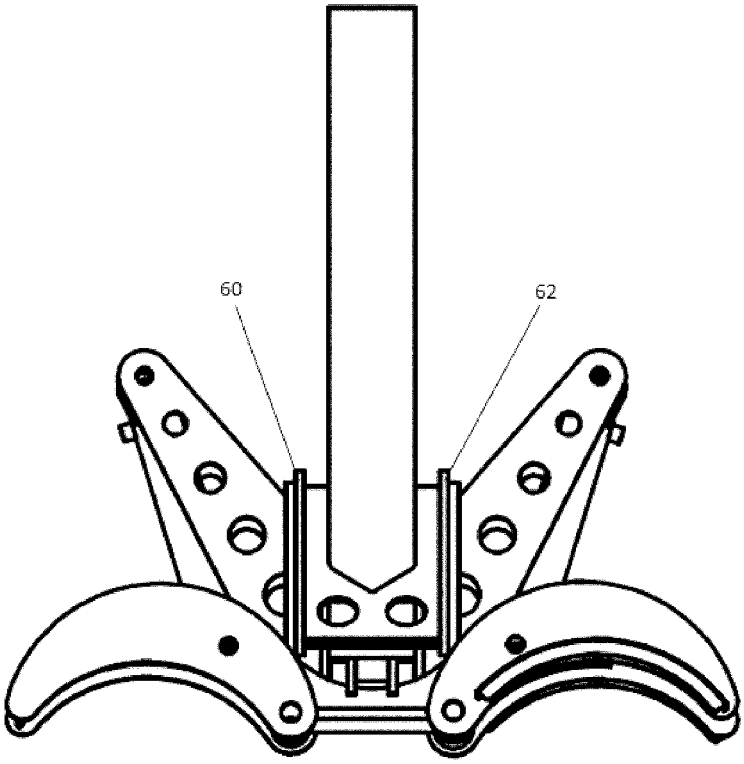
FIG. 15 shows a plan view of the grapple from an above position mounted to an outer boom, wherein the opposing jaws are fully retracted and the hydraulic cylinders are omitted. The grapple is tilted up by about 10°.

As shown in the Figures, and in particular FIGS. 15 and 22, the wings (8, 10) extend laterally outwards from the boom (4) to position the second end of the cylinders laterally outside of the first ends of the cylinders. FIG. 15 shows the jaws in a fully open position, with the cylinders fully retracted, and FIG. 22 shows the jaws in a fully closed position with the cylinders fully extended. The wings (8, 10) position the second end of the cylinders laterally outside of the first ends of the cylinders for the full range of motion of the jaws (14, 16). The wings result in the cylinders presenting a 'V' shape, i.e. diverging outwards towards the second end of the cylinders, regardless of the position of the jaws. A lateral distance between the second end of the cylinders is greater than a lateral distance between the first end of the cylinders, regardless of the position of the jaws. The lateral position of the second end of the cylinders provides for a greater range of motion. A fully closed position with a small gap between the jaws is achieved, while in the full open position the jaws are retracted so that they do not extend substantially beyond the body member (2, 6).

To provide greater flexural strength to the grapple (1), the primary body member (2) may be provided with tilt skid plates or bearing members (60 and 62) so that as the grapple jaws tilt, a base of each of the first and second wing members can slide over their respective skid plates and urge the skid plates together as the object to be grappled is restrained within the jaw members. To counteract this urging, the skid plates may be braced with support member (64). Thus, each skid plate acts against the base of the wing to support the base of the wing as the wing is forced inwards against the skid plate by the hydraulic cylinder when grabbing an object between the jaws. The skid plates allow the secondary body member to be made more lightweight, as deflection of the secondary body member caused by the cylinders acting on the wings is prevented by the skid plates.

Figure 17:
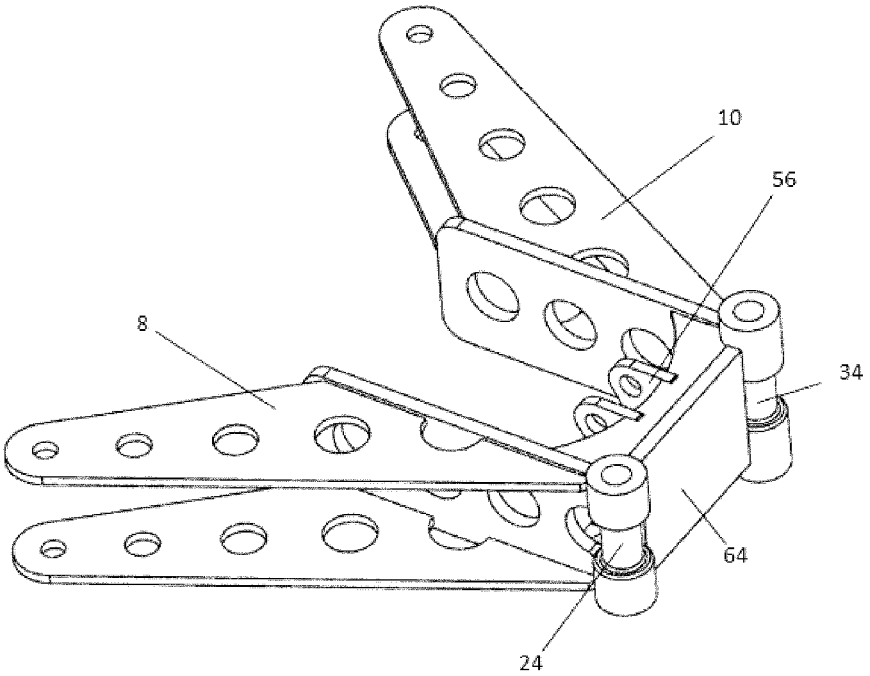
FIG. 17 shows a perspective view of the secondary body member including a first wing member and a second wing member from an above position.
Figure 18:
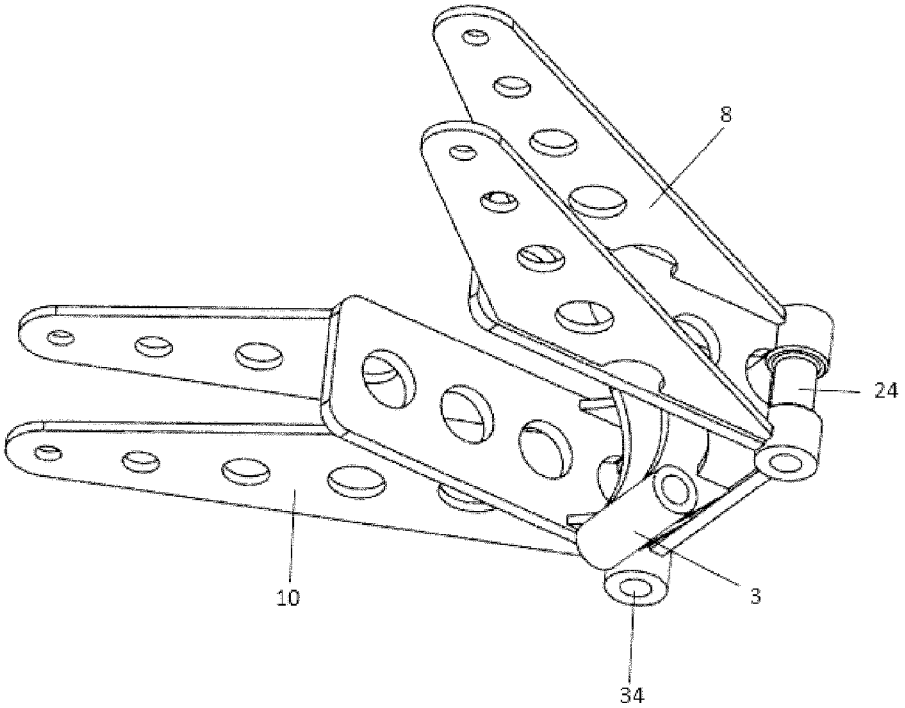
FIG. 18 shows a perspective view of the secondary body member including a first wing member and a second wing member from a below position.

FIGS. 17 and 18 show an exemplary secondary body member (6) in isolation. As shown in FIGS. 17 and 18, the base of the secondary body member is formed in a U shape, with the wings (8, 10) extending from sides of the U-shaped member. Each side of the U-shaped base forms a base for each wing (8, 10). Each skid plate acts on an inside of the U-shaped base and therefore the base of the respective wing (8, 10). A bearing or wear plate may be provided to each skid plate and/or to the inside of each side of the U shaped secondary body member 6. As the bearing or wear plate wears down it may be replaced. For example, the bearing or wear plate may be a brass plate or strip.

Figure 13:
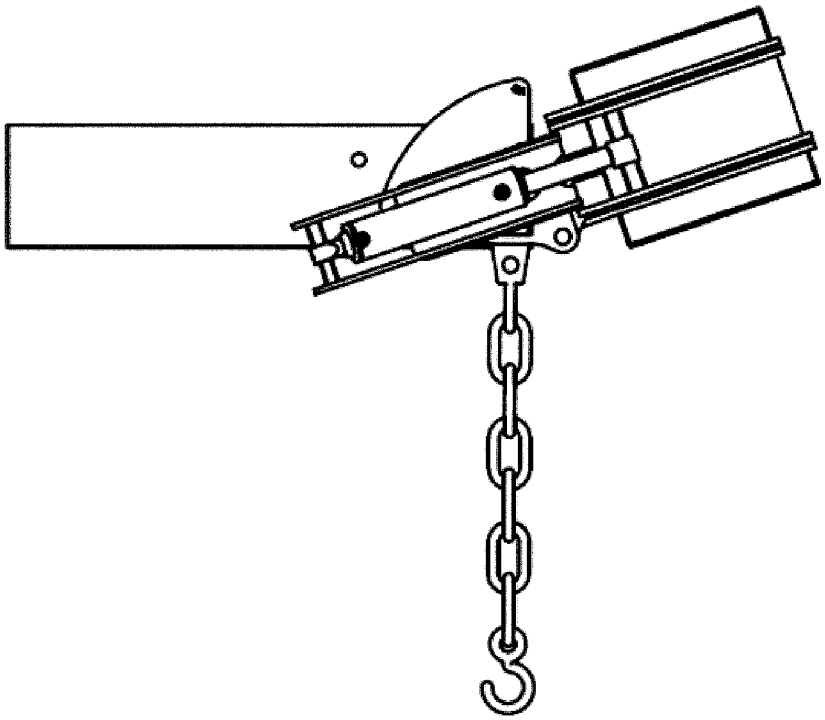
FIG. 13 shows a side view of the grapple mounted to an outer boom including a chain and hook mounted to the boom, wherein the opposing jaws are closed. The grapple is tilted up by about 10°.
Figure 14:
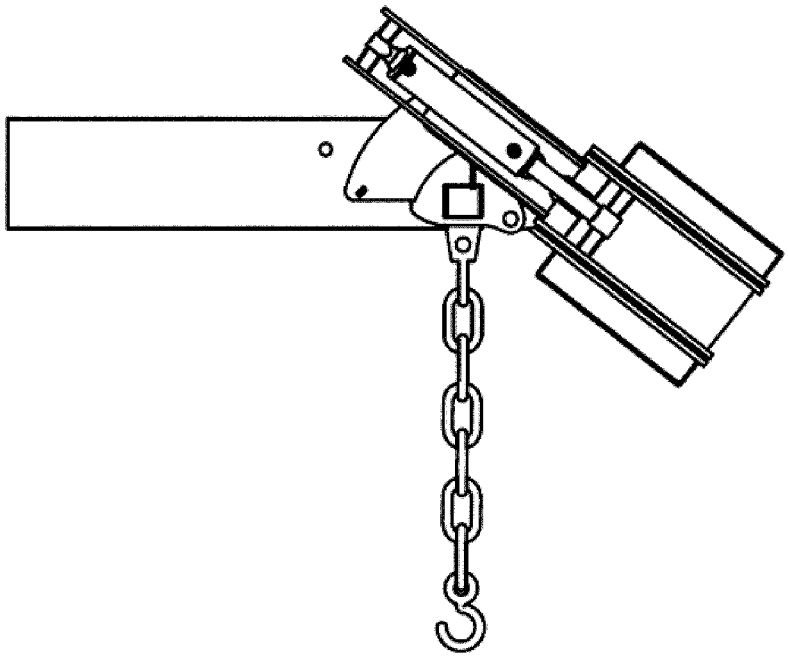
FIG. 14 shows a side view of the grapple mounted to an outer boom including a chain and hook mounted to the boom, wherein the opposing jaws are closed. The grapple is tilted down by about 30°.

The degree of tilt may, for example, range from +10° from a nominal horizontal position (shown in FIG. 13 where the boom is horizontal) to −30° from that same nominal horizontal position (shown in FIGS. 9 and 14) although this should not be seen as limiting.

Figure 19:
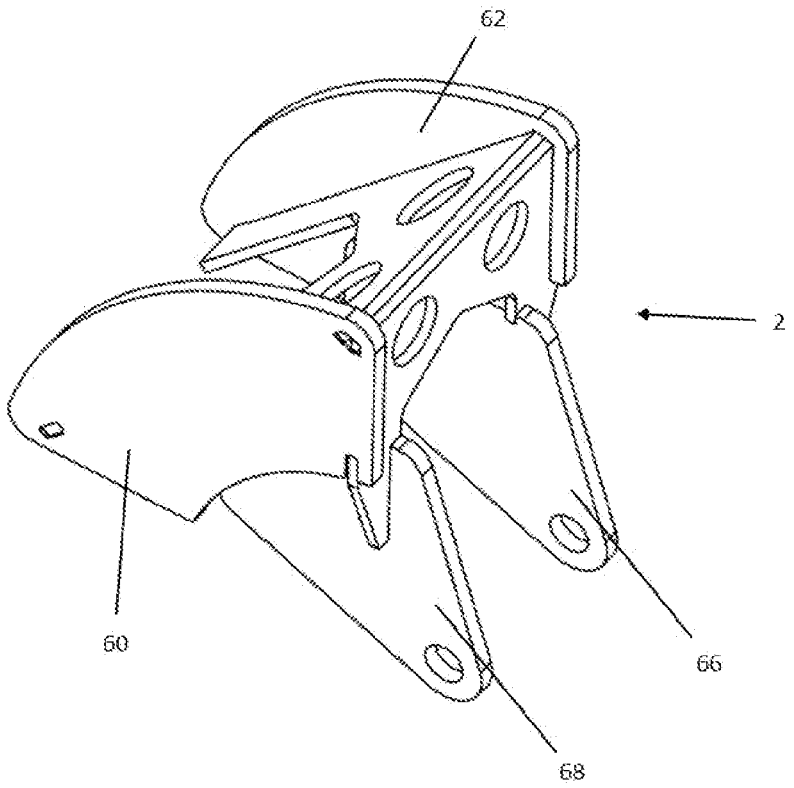
FIG. 19 shows a perspective view of the primary body member from an above position.

FIG. 19 shows an exemplary primary body member (2) in isolation. In the preferred embodiment of the invention exemplified, the hingable coupling (3) includes mounting holes in sideplates (66 and 68) which extend from primary body member (2). The sideplates (66 and 68) are preferably inward of the skidplates (60 and 62).

Figure 20:
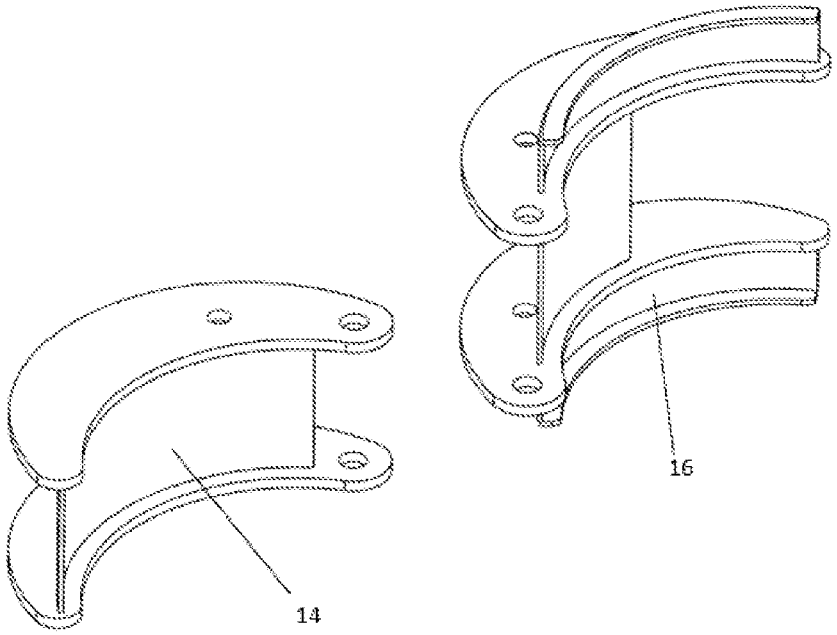
FIG. 20 shows a perspective view of both of the opposing first and second jaw members.

FIG. 20 shows exemplary first (14) and second (16) jaw members.

Figure 21:
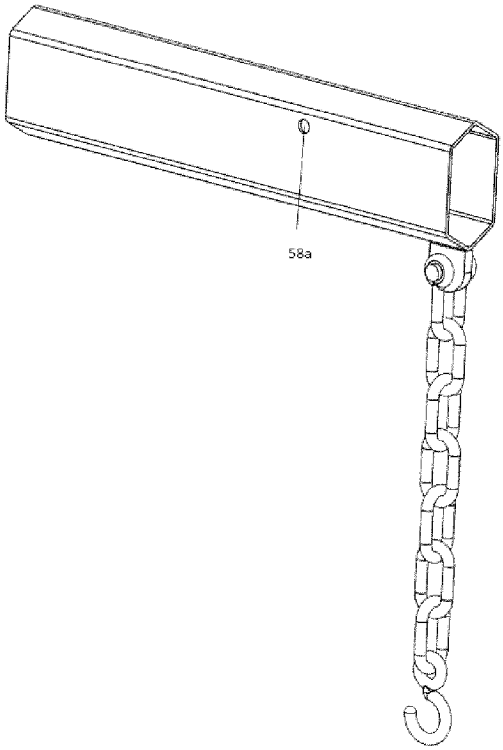
FIG. 21 shows a perspective view of an outer boom including a chain and hook mounted to the boom showing the location of a mounting hole.

FIG. 21 shows an exemplary boom (4) to which the grapple of the invention may be mounted. The boom may require modification to incorporate one or more mounting holes (58*a*). The illustrated boom (4) may be a boom extension piece permanently attached to the primary body member as part of the primary body member. For example, the boom extension piece may be welded to the primary body member. The boom extension piece (4) is coupled to the end of a boom of a boom crane. For example, an insert member may be received in the end of the boom and in the end of the boom extension, with bolts or other fasteners extending through the boom and insert, and between the boom extension and the insert, and/or by welding. In such an embodiment, once attached to the crane boom, the boom extension (4), although integrated with the body member (2), becomes a part of the boom of the crane. The illustrated boom extension piece (4) comprises a boom eye at or adjacent an end of the boom extension piece (4).

Figure 23:
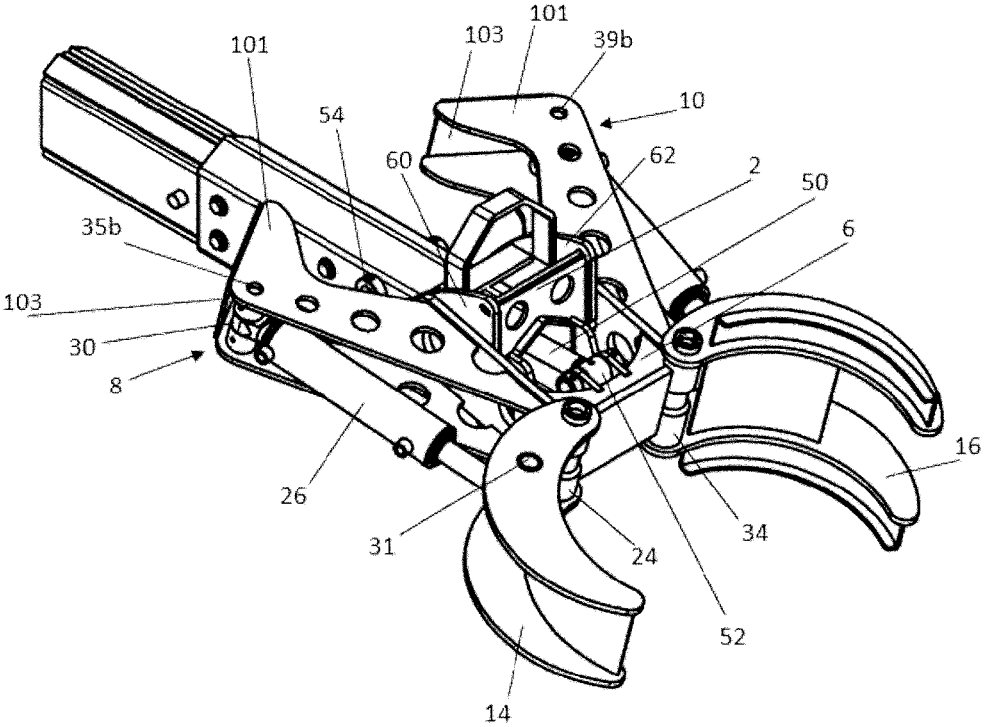
FIG. 23 shows a perspective view of another grapple from an above position mounted to an outer boom wherein the opposing jaws are semi-retracted.
Figure 24:
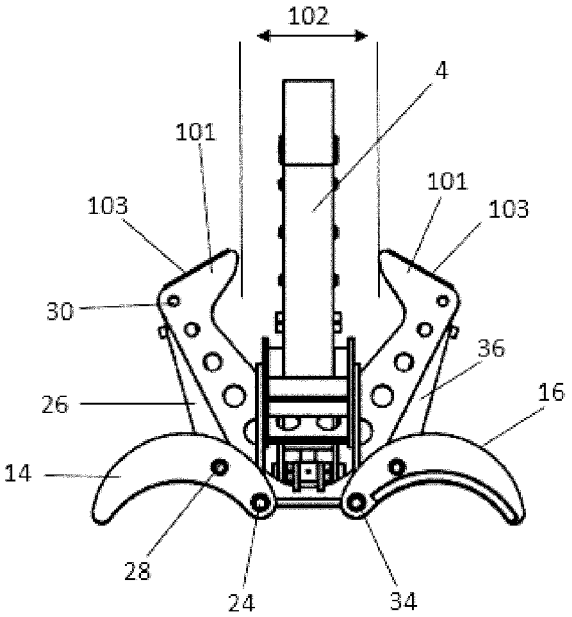
FIG. 24 shows a plan view of the grapple of FIG. 23, from an above position mounted to an outer boom, wherein the opposing jaws are fully retracted or open.
Figure 25:
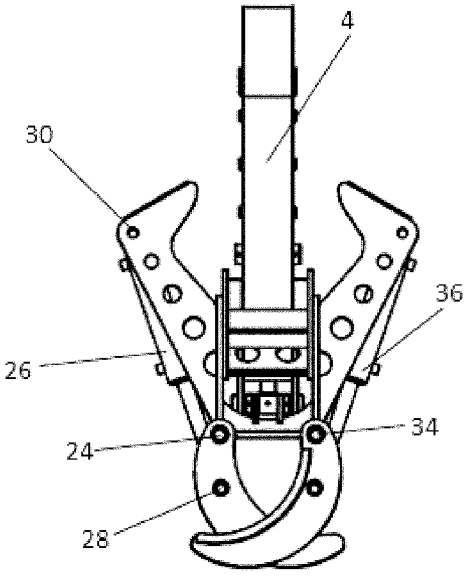
FIG. 25 shows a plan view of the grapple of FIG. 23, from an above position mounted to an outer boom, wherein the opposing jaws are fully closed.
Figure 26:
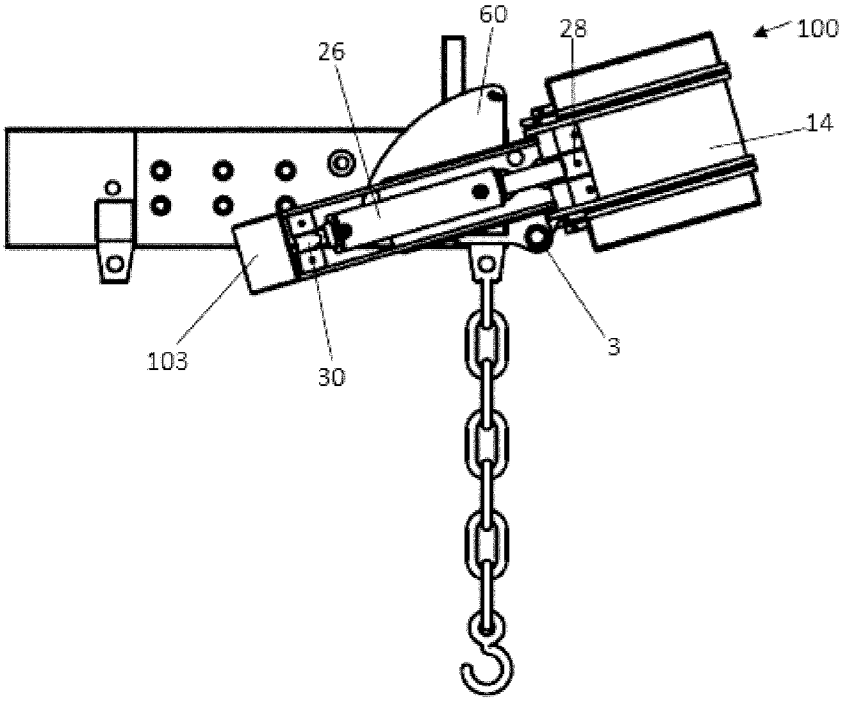
FIG. 26 shows a side view of the grapple of FIG. 23 mounted to an outer boom including a chain and hook mounted to the boom, wherein the opposing jaws are closed. The grapple is tilted up by about 10°.
Figure 27:
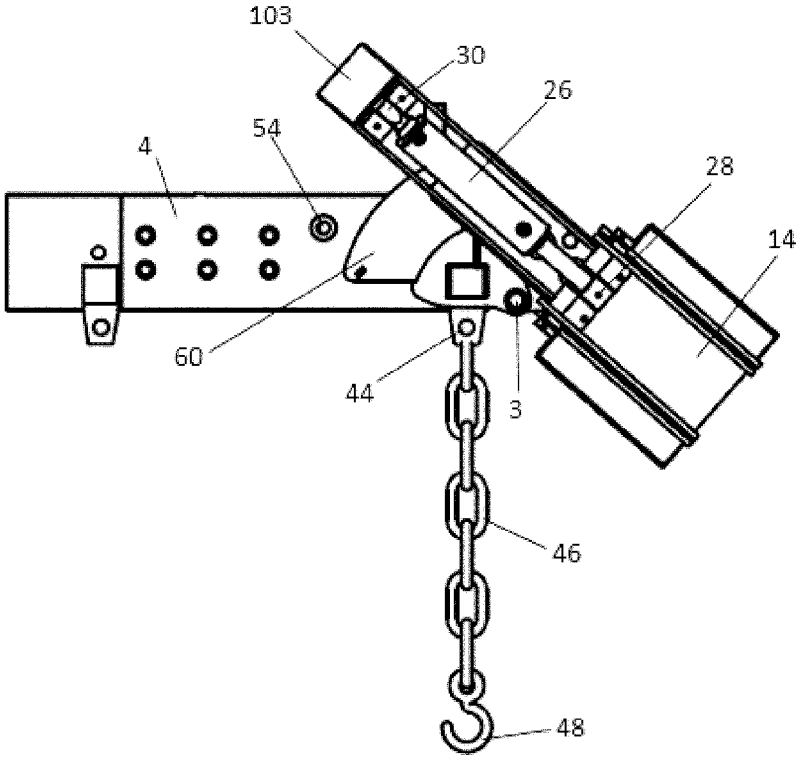
FIG. 27 shows a side view of the grapple of FIG. 23 mounted to an outer boom including a chain and hook mounted to the boom, wherein the opposing jaws are closed. The grapple is tilted down by about 30°.

FIGS. 23 to 25 illustrate a further exemplary grapple (100) of the invention. The embodiment of FIGS. 23 to 25 includes an inward projection (101) at the distal end of each wing (8, 10). The inward projections (101) reduce a lateral distance (102) between the distal ends of the wings. This may be useful to reduce the likelihood of objects such as logs lifted or to be lifted by the grapple or from the boom eye from entering and being jammed or snagged between the wings, or between a wing (8, 10) and the boom (4). In this example, each of the first and second wing members (8, 10) includes a pair of substantially identical planar members (8*a*, 8*b*, 10*a*, 10*b*), the major planes of which are substantially parallel. The wings are each provided with a lateral member (103) attached between the two inward projections (101) of planar members (8*a*, 8*b*) and (10*a*, 10*b*), to add further rigidity to each wing (8, 10).

The grapple (100) is provided with a boom extension piece (4) which is permanently attached to the primary body member. As explained above, the extension piece (4) is attached to the boom of the boom crane and becomes part of the crane boom.

In other embodiments, the grapple may be provided without articulation between a primary body member and a secondary body member. The jaws (14, 16) may be hingably coupled to a body member (2) that is fixedly mounted to the end of the boom of the boom crane.

The invention may also be said broadly to consist in the parts, elements and features referred to or indicated in the specification of the application, individually or collectively, in any or all combinations of two or more of said parts, elements or features.

Aspects of the present invention have been described by way of example only and it should be appreciated that modifications and additions may be made thereto without departing from the scope thereof as defined in the appended claims.

What we claim is:

1. A grapple for mounting to a boom of a boom crane, the grapple comprising:

a body member for mounting to an end of the boom of the boom crane, the body member including a base and a first wing member and a second wing member extending from the base; and opposing first and second jaw members:

the first jaw member is hingably coupled to the body member and the first jaw member hinges with respect to the body member by the action of a first hydraulic cylinder having a first end and a second end, wherein the first end of the first hydraulic cylinder is coupled to the first jaw member and the second end of the first hydraulic cylinder is coupled to a portion of the first wing member distal to the hingable couple between the body member and the first jaw member, and the second jaw member is hingably coupled to the body member and the second jaw member hinges with respect to the body member by the action of a second hydraulic cylinder having a first end and a second end, wherein the first end of the second hydraulic cylinder is coupled to the second jaw member and the second end of the second hydraulic cylinder is coupled to a portion of the second wing member distal to the hingable couple between the body member and the second jaw member; and wherein the first and second wing members extend to position the second end of each of the first and second hydraulic cylinders rearward of an end of the boom of the boom crane or a coupling between the body member and the boom of the boom crane, and wherein the first and second wing members extend rearwardly and laterally outwards from the base to position the second end of each of the first and second hydraulic cylinders laterally outside of the first end of each of the first and second hydraulic cylinders for a full range of motion of the first and second jaw members between a fully closed position and a fully open position, so that the first and second hydraulic cylinders diverge from the first end of the first and second hydraulic cylinders to the second end of the first and second hydraulic cylinders, and wherein in the fully open position the first end of each of the first and second hydraulic cylinders is rearward of the hingable coupling between each of the first and second jaw members and the body member, so that the first and second jaw members do not extend substantially beyond the end of the body member when in the fully open position.

2. The grapple as claimed in claim 1, wherein the body member comprises a primary body member and a secondary body member, the primary body member for mounting fixedly to the end of the boom of the boom crane and the secondary body member articulated to the primary body member by a coupling, the first and second jaw members hingably coupled to the secondary body member, and the secondary body member including the first and second wing members.

3. The grapple as claimed in claim 2, wherein the secondary body member is hingably coupled to the primary body member by the coupling.

4. The grapple as claimed in claim 3, wherein the first and second jaw members are each hingably coupled to the secondary body member about a pivot axis that is orthogonal to a pivot axis of the hingable coupling between the primary body member and the secondary body member.

5. The grapple as claimed in claim 4, further comprising a third hydraulic cylinder having a first end and a second end, wherein the first end of the third hydraulic cylinder is coupled to the secondary body member and the second end of the third hydraulic cylinder is configured to couple to the primary body member or the boom of the boom crane distal to the secondary body member, so that the secondary body member hinges with respect to the primary body member by the action of the third hydraulic cylinder.

6. The grapple as claimed in claim 5, wherein the first and second wing members extend from the secondary body member to position the second end of each of the first and second hydraulic cylinders rearward of the coupling between the primary body member and the second body member.

7. The grapple as claimed in claim 6, wherein the first and second wing members extend from the secondary body member to position the second end of each of the first and second hydraulic cylinders rearward of the primary body member.

8. The grapple as claimed in claim 7, wherein the primary body member includes a first bearing member and a second bearing member, and wherein the first wing member slides over the first bearing member and the second wing member slides over the second bearing member as the secondary body member hinges relative to the primary body member.

9. The grapple as claimed in claim 8, wherein the secondary member includes a U-shaped base, each of the first and second wing members extending from an outer side of the U-shaped base, and wherein inner sides of the U-shaped base slide over the first and second bearing members of the primary body member.

10. The grapple as claimed in claim 9, wherein in the fully open position the first end of each of the first and second hydraulic cylinders is rearward of the coupling between the primary and secondary body members.

11. The grapple as claimed in claim 10, wherein the boom includes a boom-eye for attaching a lifting element, and the first and second wing members position the second end of each of the first and second hydraulic cylinders rearward of the boom eye.

12. The grapple as claimed in claim 2, further comprising a third hydraulic cylinder having a first end and a second end, wherein the first end of the third hydraulic cylinder is coupled to the secondary body member and the second end of the third hydraulic cylinder is configured to couple to the primary body member or the boom of the boom crane distal to the secondary body member, so that the secondary body member hinges with respect to the primary body member by the action of the third hydraulic cylinder.

13. The grapple as claimed in claim 12, wherein the first and second wing members extend from the secondary body member to position the second end of each of the first and second hydraulic cylinders rearward of the coupling between the primary body member and the second body member.

14. The grapple as claimed in claim 2, wherein the first and second wing members extend from the secondary body member to position the second end of each of the first and second hydraulic cylinders rearward of the primary body member.

15. The grapple as claimed in claim 2, wherein the primary body member includes a first bearing member and a second bearing member, and wherein the first wing member slides over the first bearing member and the second wing member slides over the second bearing member as the secondary body member hinges relative to the primary body member.

16. The grapple as claimed in claim 15, wherein the secondary member includes a U-shaped base, each of the first and second wing members extending from an outer side of the U-shaped base, and wherein inner sides of the U-shaped base slide over the first and second bearing members of the primary body member.

17. The grapple as claimed in claim 2, wherein in the fully open position the first end of each of the first and second hydraulic cylinders is rearward of the coupling between the primary and secondary body members.

18. The grapple as claimed in claim 2, wherein the boom includes a boom-eye for attaching a lifting element, and the first and second wing members position the second end of each of the first and second hydraulic cylinders rearward of the boom eye.

* * * * *